US009700184B2

(12) United States Patent
Stein

(10) Patent No.: US 9,700,184 B2
(45) Date of Patent: Jul. 11, 2017

(54) FLOOR CARE APPLIANCE

(71) Applicant: Stein & Co. GmbH, Velbert (DE)

(72) Inventor: Thomas Stein, Velbert (DE)

(73) Assignee: STEIN & CO. GmbH, Velbert (DE)

( * ) Notice: Subject to any disclaimer, the term of this patent is extended or adjusted under 35 U.S.C. 154(b) by 91 days.

(21) Appl. No.: 14/704,000

(22) Filed: May 5, 2015

(65) Prior Publication Data

US 2015/0313427 A1 Nov. 5, 2015

(30) Foreign Application Priority Data

May 5, 2014 (DE) ..... 10 2014 006 982
Jul. 7, 2014 (DE) ..... 10 2014 008 458

(51) Int. Cl.
*A47L 5/30* (2006.01)
*A47L 9/04* (2006.01)
*A47L 9/24* (2006.01)

(52) U.S. Cl.
CPC *A47L 5/30* (2013.01); *A47L 9/04* (2013.01); *A47L 9/0411* (2013.01); *A47L 9/0477* (2013.01); *A47L 9/246* (2013.01); *A47L 9/248* (2013.01)

(58) Field of Classification Search
CPC ... A47L 5/30; A47L 9/04; A47L 9/246; A47L 9/0411; A47L 9/28
See application file for complete search history.

(56) References Cited

U.S. PATENT DOCUMENTS 4,146,283 A 3/1979 Lienenlüke et al.
4,517,705 A 5/1985 Hug
4,670,937 A 6/1987 Sumerau et al.
5,228,169 A * 7/1993 Stein ..... A47L 5/30 15/351
5,309,600 A 5/1994 Weaver et al.
5,584,095 A 12/1996 Redding et al.
6,277,164 B1 8/2001 Embree et al.
2013/0160231 A1 6/2013 Streciwilk et al.

FOREIGN PATENT DOCUMENTS

DE 3220644 12/1983
JP 2002165735 6/2002
WO 9417716 A1 8/1994
WO 0059360 A1 10/2000

OTHER PUBLICATIONS

German Search Report, Jul. 7, 2014.
EP Search Report for corresponding EP Application No. 15 16 6364, dated Sep. 29, 2015.

* cited by examiner

*Primary Examiner* — David Redding
(74) *Attorney, Agent, or Firm* — Greer Burns & Crain, Ltd.

(57) ABSTRACT

In a vacuum cleaner it is provided that a brush set can be connected via a pivotable connecting element in the form of a connecting piece for an attachable filter housing to a handle in the form of a hand grip. Here the brush set has an electric motor for a suction fan and for the drive of the brush roller. The pivotable connecting element of the brush set has an external connector plug for an electrical connection to an appliance coupling of a power line connection lead for connection to a power supply, for example, for connection to a wall socket and the like. As a result, the brush set with the integrated motor and a switch for operating control forms a functional electrical unit.

9 Claims, 5 Drawing Sheets

FLOOR CARE APPLIANCE

CROSS-REFERENCES TO RELATED APPLICATIONS

This application claims the benefit of the German patent application No. 10 2014 008 458.2 filed on Jul. 7, 2014, and of the German patent application No. 10 2014 996 982.6 filed on May 5, 2014, the entire disclosures of which are incorporated herein by way of reference.

BACKGROUND OF THE INVENTION

The invention relates to a floor care appliance in the form of a brush vacuum cleaner having a brush set facing the floor for receiving a driven brush roller, where the brush set can be connected by means of a pivotable connecting element in the form of a connecting piece for an attachable filter housing to a handle in the form of a hand grip via corresponding connections and where the brush set has at least one electric motor for a suction fan and for the drive of the brush roller.

In known devices of this type, an electrical mains (power line) connection lead for connection to a power supply is firmly connected to the attachable filter housing and the switch for operation is disposed in the region of a handle of the filter housing for manual operation. As a result, at corresponding interfaces it is necessary to provide electrical junctions in order to control the electrical drive disposed in the brush set. These arrangements have the shortcoming that when handled incorrectly, faults occur and the entire device must be available for electrical repairs. Documentary prior art is disclosed in US 2013 0 160 231 A1, U.S. Pat. No. 5,584,095 A, DE 32 20 644 A1, U.S. Pat. No. 4,670,937 A and in JP 2002 165 735 A.

Furthermore, an exchange of the mains connection lead in the event of defects or the use or exchange of different lengths of mains connection leads can only be performed by the person skilled in the art.

SUMMARY OF THE INVENTION

It is an object of the invention to improve a generic floor care appliance by means of a configuration and create a simple arrangement which allows an attachable filter housing without integrated electrical elements and to ensure a flexible tool-free exchange of mains (power line) connection leads for handling by laypersons.

This object is solved according to the invention whereby the pivotable connecting element of the brush set has an external or externally accessible receptacle for a connector plug for the detachable electrical connection to an appliance coupling of a mains connection lead for connection to a power supply and the brush set with the integrated motor and a switch for operating control forms a functional electrical unit.

The advantage of this configuration consists in that the electrical units including an electrical connection are only disposed in the brush set and consequently the filter housing is formed as a separate mechanical unit.

It is further provided that the connector plug is designed as an appliance male connector and is positively connected to the pivotable connecting element.

It is further proposed that the appliance male connector and the appliance coupling are configured as an IEC (International Electrotechnical Commission) appliance connection.

An advantageous arrangement consists in that the appliance male connector on the pivotable connecting element is assigned a guide sleeve.

In order to improve the operating mode with the brush vacuum cleaner, it is provided that the filter housing has an external or externally accessible receiving gap guided towards the upper region of the filter housing for the mains connection lead connected to the appliance coupling, wherein the mains connection lead can be fixed detachably in the receiving gap.

Here it is provided that the receiving gap for the mains connection lead on the filter housing is guided behind a detachable suction handle for auxiliary suction work such as a hose, a suction tube or a hose-tube combination.

It is further provided that the hand grip in the form of a handle of the filter housing has a receptacle for the mains connection lead with a strain relief. At the same time, it is provided that the strain relief of the mains connection lead is designed to be detachable by means of a spring button.

In order to secure the connection between plug connector and appliance coupling, it is proposed that after connection, the electrical appliance coupling connected to the mains connection lead is embedded in a niche of the filter housing, wherein the direction of release of the appliance coupling can be blocked by means of an associated edge.

BRIEF DESCRIPTION OF THE DRAWINGS

An exemplary embodiment of the invention is shown schematically in the drawings. In the figures.

DETAILED DESCRIPTION OF THE PREFERRED EMBODIMENTS

Figure 1:
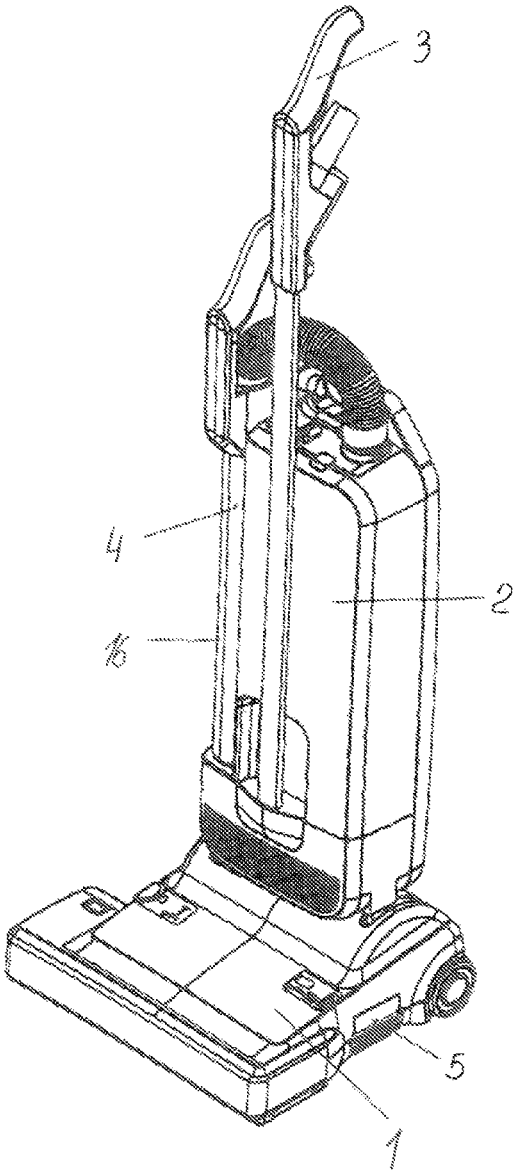
FIG. 1 shows a brush vacuum cleaner with a brush set and a filter housing placed thereon.
Figure 2:
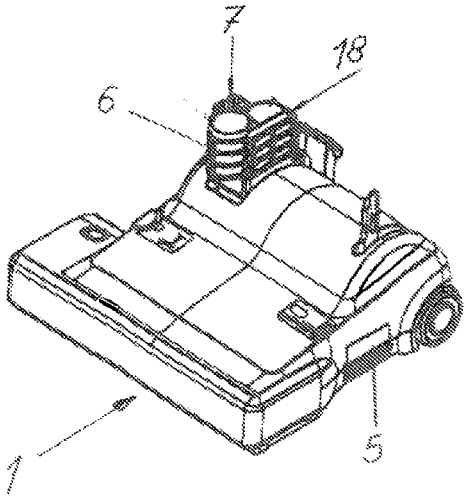
FIG. 2 shows a brush set with a pivotable connecting element.

The brush vacuum cleaner shown comprises a brush set 1 and an attachable filter housing 2 with a hand grip in the form of a handle 3 and a detachable suction handle 4 for auxiliary suction work as hose-tube combination. An electric motor for a suction fan and for driving a brush roller which are not shown in detail are accommodated in the brush set 1. The connection between brush set 1 and filter housing 2 is made via a pivotable connecting element 6 with air guiding channels 18 in the form of connecting piece. In addition, a switch 5 for switching the brush vacuum cleaner on and off is provided on the edge of the brush set 1 for controlling operation.

Figure 3:
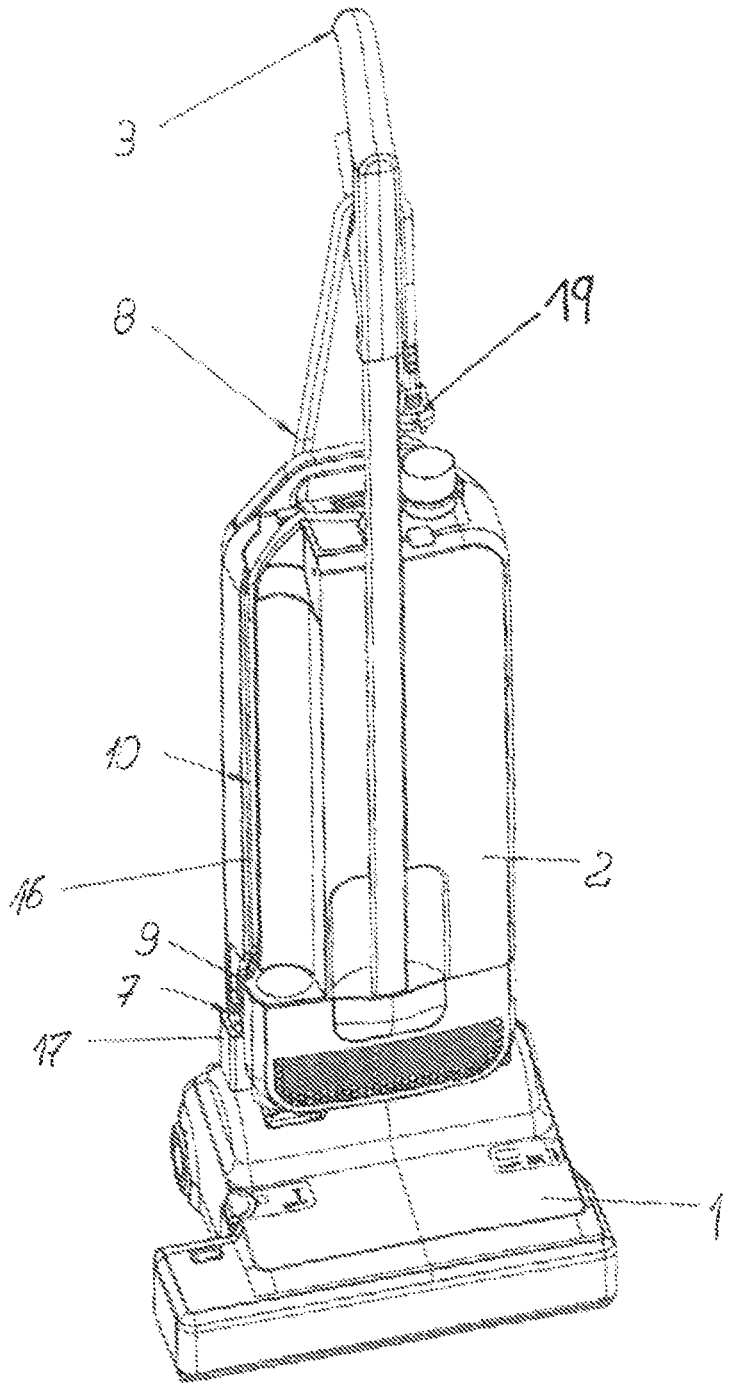
FIG. 3 shows a view corresponding to FIG. 1 without detachable suction handle with inserted mains connection lead in a receiving gap of the filter housing.
Figure 4:
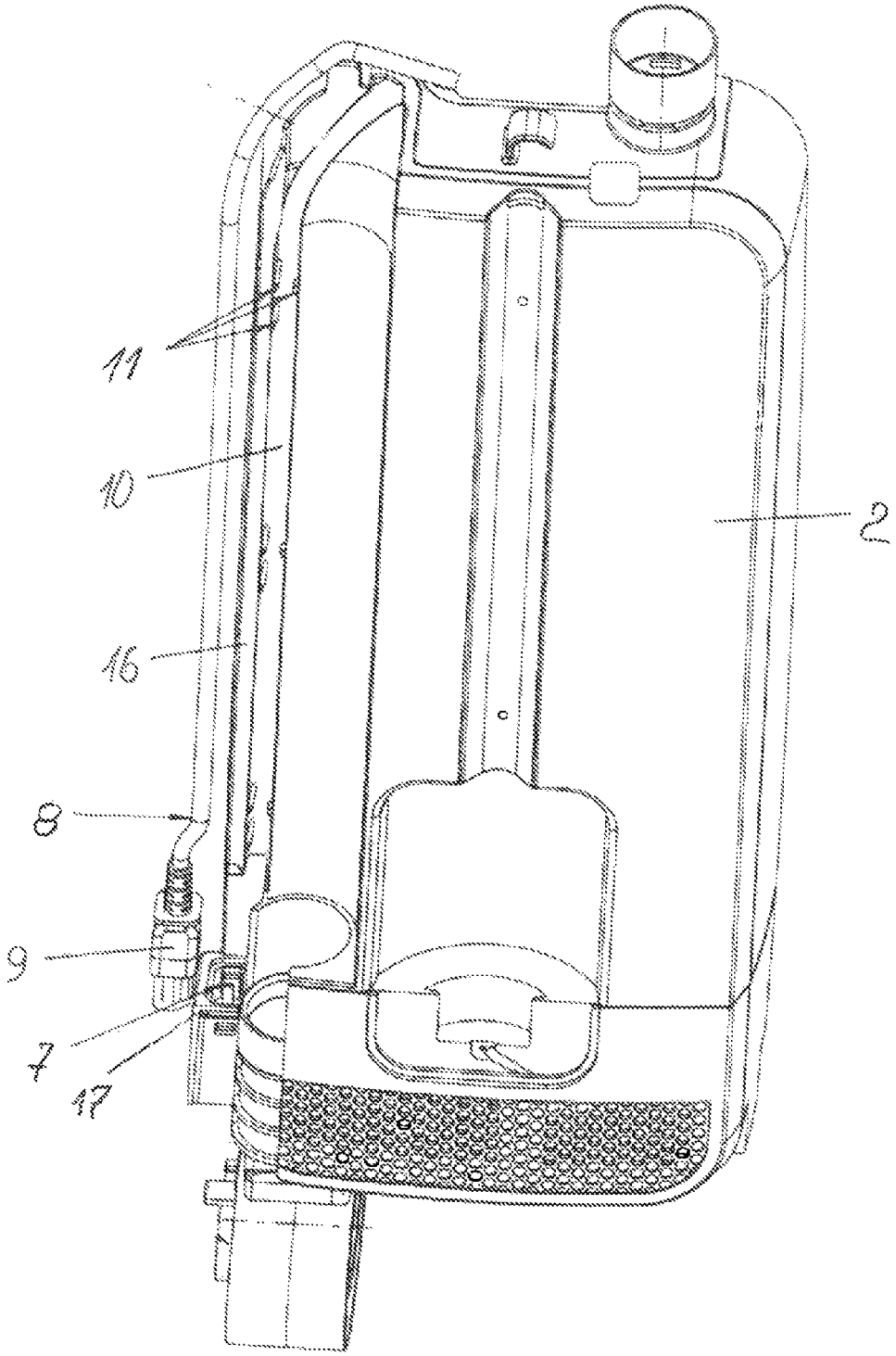
FIG. 4 shows an enlarged view of the filter housing with receiving gap and insertable mains connection lead with appliance coupling and associated connecting element with plug connector.
Figure 5:
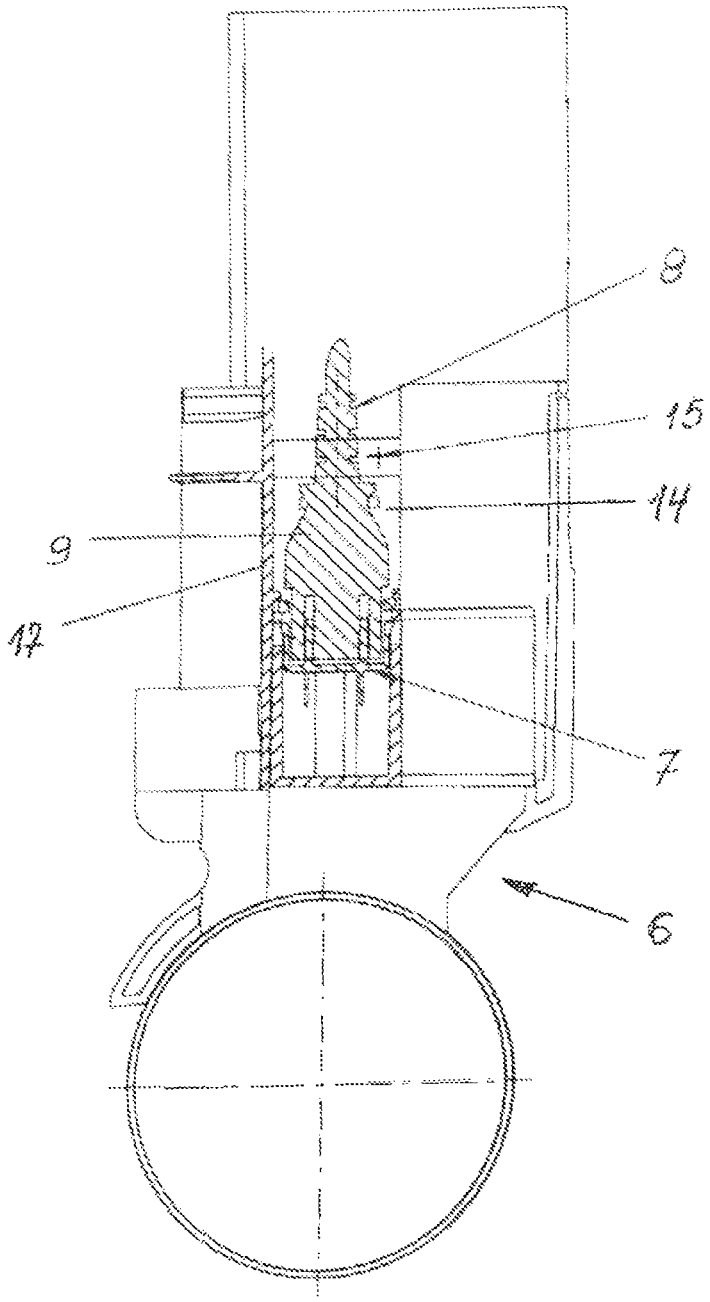
FIG. 5 shows a schematic view of the connected appliance coupling and plug connector and FIG. 6 shows a handle of the filter housing with a strain relief of the mains connection lead.
Figure 6:
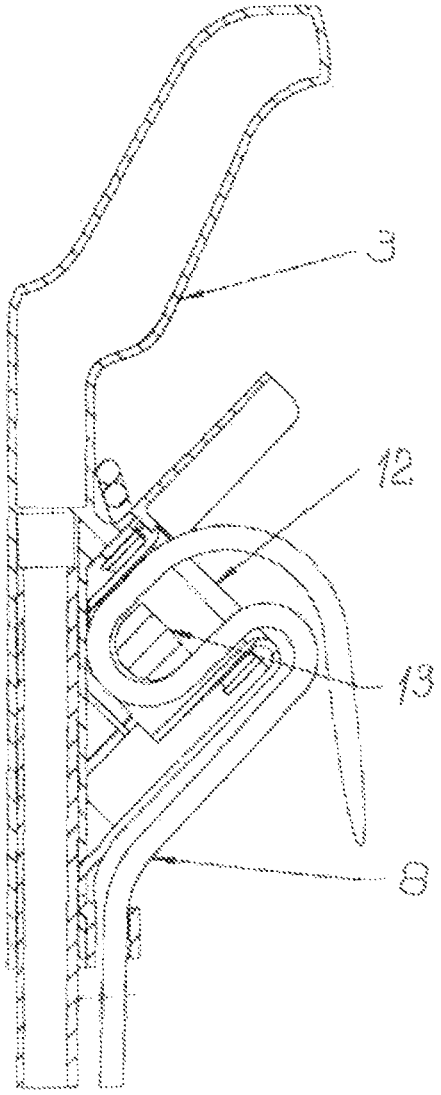

For the electrical connection, the pivotable connecting element 6 has an external or externally accessible receptacle for a plug connector 7 which is interconnected via internal leads to the motor and the switch 5 in the brush set 1. An appliance coupling 9 connected to a mains (power line) connection lead 8 for the electrical power supply can be plugged onto the plug connector 7. For example, in FIG. 3 a plug 19 for plugging into a wall socket for connection to a power supply is shown at the free end of the mains connection lead 8. In this case, the appliance coupling 9 is assigned a guide sleeve 17 on the pivotable connecting element 6. The mains connection lead 8 is inserted via a receiving gap 10 formed externally in the upper region of the attached filter housing 2 and detachably fastened via retaining elements 11. In this case, the mains connection lead 8 is guided as far as the hand grip 3 in the form of a handle and is fixed in a receptacle 12 to form a strain relief The strain relief is designed to be detachable by means of an associated spring button 13.

The appliance coupling 9 connected to the plug connector 7 can be inserted into an associated niche 14 in the filter housing 2, where the appliance coupling 9 can be fixed in the direction of release by means of an edge 15.

In this exemplary embodiment the external or externally accessible receiving gap 10 for the mains connection lead 8 is located in a receptacle 16 of the filter housing 2 for a detachable suction handle 4 as a hose-tube combination for carrying out auxiliary suction work so that the mains connection lead 8 is guided behind the suction handle 4 in the inserted state.

As a result of this configuration, the brush set 1 is equipped electrically functionally and the filter housing 2 is configured for a detachable mechanical receipt of the mains connection lead 8.

In a vacuum cleaner it is provided that a brush set can be connected by means of a pivotable connecting element in the form of a connecting piece for an attachable filter housing to a handle in the form of a hand grip. Here the brush set has an electric motor for a suction fan and for the drive of the brush roller. The pivotable connecting element of the brush set has an external connector plug for an electrical connection to an appliance coupling of a mains connection lead for connection to a power supply, for example, for connection to a wall socket and the like. As a result, the brush set with the integrated motor and a switch for operating control forms a functional electrical unit.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. A floor care appliance in the form of a brush vacuum cleaner comprising:

a brush set facing the floor for receiving a driven brush roller, a pivotable connecting element configured to connect the brush set and being in the form of a connecting piece for an attachable filter housing to a handle in the form of a hand grip via corresponding connections, the brush set having at least one electric motor for a suction fan and for the drive of the brush roller, the pivotable connecting element of the brush set having an external receptacle for a connector plug for a detachable electrical connection to an appliance coupling of a power line connection lead and the brush set with the integrated motor, and a switch configured to provide operating control forming a functional electrical unit.

2. The floor care appliance according to claim 1, wherein the connector plug is an appliance male connector and is positively connected to the pivotable connecting element.

3. The floor care appliance according to claim 1, wherein the connector plug is an appliance male connector, and wherein the appliance male connector and the appliance coupling are configured as an IEC appliance connection.

4. The floor care appliance according to claim 1, wherein a guide sleeve is provided at the external receptacle of the pivotable connecting element.

5. The floor care appliance according to claim 1, wherein the filter housing has an external receiving gap guided towards the upper region of the filter housing for the power line connection lead connected to the appliance coupling, wherein the power line connection lead is detachably fixed in the receiving gap.

6. The floor care appliance according to claim 5, wherein the receiving gap for the power line connection lead on the filter housing is guided behind a detachable suction handle for auxiliary suction work including at least one of a hose, a suction tube and a hose-tube combination.

7. The floor care appliance according to claim 1, wherein after connection, the electrical appliance coupling connected to the power line connection lead engages in a niche of the filter housing, wherein the direction of release of the appliance coupling is blocked by means of an associated edge.

8. The floor care appliance according to claim 1, wherein the hand grip in the form of a handle of the filter housing has a receptacle for the power line connection lead with a strain relief.

9. The floor care appliance according to claim 8, wherein the strain relief of the power line connection lead is detachable by means of a spring button.

* * * * *